US010478791B2

(12) United States Patent
Morinaga et al.

(10) Patent No.: US 10,478,791 B2
(45) Date of Patent: Nov. 19, 2019

(54) STIRRING DEVICE

(71) Applicants: Sumitomo Heavy Industries Process Equipment Co., Ltd., Saijo-shi (JP); IZUMI FOOD MACHINERY Co., Ltd., Amagasaki-shi (JP)

(72) Inventors: Shoji Morinaga, Saijo (JP); Katsuhide Takenaka, Saijo (JP); Keiji Esaki, Saijo (JP); Tetsuya Miyata, Saijo (JP); Soushi Murakami, Saijo (JP); Daisuke Sugifune, Amagasaki (JP)

(73) Assignees: Sumitomo Heavy Industries Process Equipment Co., Ltd., Saijo-shi (JP); IZUMI FOOD MACHINERY Co., Ltd., Amagasaki-shi (JP)

( * ) Notice: Subject to any disclaimer, the term of this patent is extended or adjusted under 35 U.S.C. 154(b) by 30 days.

(21) Appl. No.: 15/738,713

(22) PCT Filed: Jun. 30, 2016

(86) PCT No.: PCT/JP2016/069421
§ 371 (c)(1),
(2) Date: Dec. 21, 2017

(87) PCT Pub. No.: WO2017/002905
PCT Pub. Date: Jan. 5, 2017

(65) Prior Publication Data

US 2018/0178176 A1 Jun. 28, 2018

(30) Foreign Application Priority Data

Jul. 1, 2015 (JP) ..... 2015-132830

(51) Int. Cl.
*B01F 7/22* (2006.01)
*B01F 3/08* (2006.01)
(Continued)

(52) U.S. Cl.
CPC ..... *B01F 7/22* (2013.01); *B01F 3/08* (2013.01); *B01F 3/0807* (2013.01);
(Continued)

(58) Field of Classification Search
CPC ..... B01F 15/065; B01F 2015/061; B01F 2015/062; B01F 3/08; B01F 3/0807;
(Continued)

(56) References Cited

U.S. PATENT DOCUMENTS 1,046,832 A * 12/1912 Miller ..... B01F 7/166 366/296
1,240,869 A * 9/1917 Nobel ..... B01F 15/068 165/61
(Continued)

FOREIGN PATENT DOCUMENTS

CN 1108147 A 9/1995
DE 10 2011 006 636 A1 * 10/2012
(Continued)

OTHER PUBLICATIONS

Search Report for TW 105120806, dated Jun. 2019, 8 pages.

*Primary Examiner* — Tony G Soohoo
(74) *Attorney, Agent, or Firm* — The Webb Law Firm

(57) ABSTRACT

Provided is a stirring device including: a stirred tank, of which an inner peripheral wall has a circular shape in cross section; and at least one flow impeller and at least one shearing impeller that are located inside the stirred tank and configured to be rotatable independently of each other, in which rotational centers of the flow impeller and the shearing impeller are coaxially provided, the flow impeller rotates around a vertical axis along the inner peripheral wall of the stirred tank to form at least a flow directed toward a lower side in the stirring object existing in the stirred tank, and the shearing impeller imparts a shearing force to the stirring
(Continued)

object and is provided on a radially inward side of the flow impeller in the stirred tank and at a position contacting the flow of the stirring object formed by the flow impeller.

7 Claims, 5 Drawing Sheets

(51) Int. Cl.
*B01F 3/10* (2006.01)
*B01F 7/00* (2006.01)
*B01F 15/06* (2006.01)
*B01F 7/16* (2006.01)

(52) U.S. Cl.
CPC ..... *B01F 3/0853* (2013.01); *B01F 3/10* (2013.01); *B01F 7/006* (2013.01); *B01F 7/00341* (2013.01); *B01F 7/00441* (2013.01); *B01F 7/166* (2013.01); *B01F 15/065* (2013.01); *B01F 2015/061* (2013.01); *B01F 2015/062* (2013.01)

(58) Field of Classification Search
CPC ..... B01F 3/0853; B01F 3/10; B01F 7/00341; B01F 7/00441; B01F 7/006; B01F 7/166; B01F 7/22
USPC ..... 366/292, 294, 296
See application file for complete search history.

(56) References Cited

U.S. PATENT DOCUMENTS 1,585,169 A * 5/1926 Perkins ..... B01F 7/00158 366/303
1,737,090 A * 11/1929 Meyers ..... B65G 65/46 198/531
2,203,135 A * 6/1940 Farrington ..... B01F 7/30 366/288
2,298,317 A * 10/1942 Smith ..... B01D 19/0052 508/534
2,367,149 A * 1/1945 Smith ..... B01D 19/0052 165/109.1
3,148,802 A * 9/1964 Webb ..... B65B 65/02 222/241
3,248,019 A * 4/1966 Kohler ..... B65D 88/68 222/181.2
3,251,512 A * 5/1966 Irving ..... B65D 88/68 222/227
3,305,133 A * 2/1967 Parker ..... A01K 5/0258 192/142 R
3,365,177 A * 1/1968 Daman ..... B01F 7/16 366/138
3,445,090 A * 5/1969 Lucke ..... B29C 48/286 366/266
3,508,882 A * 4/1970 Farnell ..... B01F 7/247 159/25.2
3,820,761 A * 6/1974 Rigal ..... B01F 7/00216 366/320
3,877,881 A * 4/1975 Ono ..... B01F 7/00208 165/109.1
3,948,421 A * 4/1976 Marchadour ..... B65B 37/10 222/240
4,022,438 A * 5/1977 Shishido ..... B01F 7/00391 366/310
4,049,244 A * 9/1977 Hedrich ..... B01F 7/00208 366/143
4,225,247 A * 9/1980 Hodson ..... B01F 7/0065 366/312
4,231,664 A * 11/1980 Flock ..... B22C 5/0413 366/156.2
4,245,399 A * 1/1981 Muller ..... B01F 7/247 34/166
4,391,529 A * 7/1983 Hedrich ..... B01F 7/00208 366/181.4
4,403,868 A * 9/1983 Kupka ..... B01F 7/166 277/500
4,515,483 A * 5/1985 Muller ..... F26B 11/14 366/303
4,552,461 A * 11/1985 Ott ..... B01F 7/0025 366/194
4,808,005 A * 2/1989 Lewis ..... B01F 7/00641 366/196
5,102,229 A 4/1992 Wada et al.
5,122,038 A * 6/1992 Malkoski ..... B01F 7/00641 285/311
5,182,087 A * 1/1993 Lilja ..... B01F 7/247 210/208
5,188,808 A * 2/1993 Lilja ..... B01D 19/0052 366/307
5,248,485 A * 9/1993 Lilja ..... B01D 19/0052 366/59
5,339,998 A * 8/1994 Warren ..... B65D 88/68 222/241
5,382,092 A * 1/1995 Okamoto ..... B01F 7/246 366/320
5,411,710 A * 5/1995 Iwasyk ..... B01F 7/245 366/320
5,506,336 A * 4/1996 Iwasyk ..... B01F 7/245 264/101
5,518,312 A * 5/1996 Inoue ..... B01F 7/166 241/46.17
5,549,384 A 8/1996 Reynolds
5,611,619 A * 3/1997 Shen ..... B01F 7/00208 366/244
5,674,956 A * 10/1997 Nakamoto ..... B01F 7/00175 526/88
5,683,178 A * 11/1997 Nakamoto ..... B01F 7/00175 366/325.3
5,718,510 A * 2/1998 Farmery ..... B01F 7/00008 366/266
5,806,977 A * 9/1998 Farmery ..... B01F 7/00008 366/348
5,909,829 A * 6/1999 Wegman ..... B65B 1/08 222/232
5,979,807 A * 11/1999 Pellicer ..... B01F 5/0262 241/101.8
6,296,384 B1 * 10/2001 Yatomi ..... B01F 7/00291 366/147
6,390,664 B1 * 5/2002 Kniele ..... B01F 7/00208 222/241
8,485,716 B2 * 7/2013 Handa ..... B01F 7/00133 366/270
9,085,020 B2 * 7/2015 Lehtinen ..... B01F 7/00441
9,352,290 B2 * 5/2016 Lilja ..... B01D 11/0457
2004/0233780 A1 * 11/2004 de Oliveira Picho .. B01F 7/166 366/279
2005/0014922 A1 * 1/2005 Muller ..... B01F 7/245 528/271
2014/0169120 A1 6/2014 Brown
2015/0109877 A1 * 4/2015 Multner ..... B01F 3/1221 366/138
2017/0326516 A1 * 11/2017 Mortensen ..... B01F 5/106
2018/0178176 A1 * 6/2018 Morinaga ..... B01F 3/08

FOREIGN PATENT DOCUMENTS

DE 102011006636 A1 * 10/2012 ..... B01F 7/00208
EP 0461746 A2 12/1991
GB 2220585 A 1/1990
JP 6452536 U 3/1989
JP 585433 A 4/1993
JP 6510699 A 1/1994
JP 8150330 A 6/1996
JP 11276871 A 10/1999
JP 3001387 B2 1/2000

* cited by examiner

STIRRING DEVICE

CROSS-REFERENCE TO RELATED APPLICATIONS

This application is the United States national phase of International Application No. PCT/JP2016/069421 filed Jun. 30, 2016, and claims priority to Japanese Patent Application No. 2015-132830 filed Jul. 1, 2015, the disclosures of which are hereby incorporated in their entirety by reference.

FIELD OF THE INVENTION

The present invention relates to a stirring device that is used for stirring a stirring object having fluidity.

BACKGROUND OF THE INVENTION

Conventionally, stirring devices having various configurations exist. For example, there is a stirring device disclosed in Patent Literature 1. This stirring device includes a stirring tank for housing a stirring object, a ribbon-shaped stirring impeller configured to cause the stirring object to have fluidity within the stirred tank, and a high-speed rotation stirring impeller configured to shear the stirring object.

The stirring object around shearing teeth is pumped out at the time of shearing the stirring object using the high-speed rotation stirring impeller. Unless a sufficient amount of the stirring object is supplemented so as to compensate the pumped out stirring object, the stirring object may not easily flow into an area with the stirring object pumped out therefrom from the surrounding area in some cases. In such a case, a space (hollow space) with no stirring object created around the shearing teeth (or around the high-speed rotation stirring impeller itself) is caused. Accordingly, the shearing blade cannot catch the stirring object and thereby the high-speed rotation stirring impeller runs idle, which may cause a phenomenon of making it hard for the stirring object to be sheared.

This phenomenon is more easily caused when the high-speed stirring impeller rotates at a higher speed. Further, this phenomenon is highly likely to be caused when the stirring object is a high viscosity fluid and a highly thixotropic fluid (a fluid having properties which makes its flow hard to be propagated, such as creamy fluid).

Meanwhile, in the device of Patent Literature 1, no attention is paid on such a problem, and the ribbon-shaped stirring impeller and the high-speed rotation stirring impeller are arranged in random manner, with no organic relationship therebetween. Therefore, the stirring device disclosed in Patent Literature 1 does not cause fluidity within the stirred tank which enables a sufficient amount of the stirring object to be supplemented so as to compensate the stirring object pumped out by the shearing blade, and therefore the problem of pausing a difficulty in shearing due to the space caused around the high-speed stirring impeller still remains unsolved.

PRIOR ART REFERENCE

Patent Literature

Patent Literature 1: Japanese UM Application Laid-open No. 115-85433

SUMMARY

Technical Problem

An object of the present invention is to provide a stirring device that suppress occurrence of a phenomenon of pausing a difficulty in shearing a stirring object.

Solution to Problem

The present invention is a stirring device for stirring a stirring object having fluidity that includes a stirred tank, of which an inner peripheral wall has a circular shape in cross section, and at least one flow impeller and at least one shearing impeller that are located inside the stirred tank and configured to be rotatable independently of each other, wherein rotational centers of the flow impeller and the shearing impeller are coaxially provided, the flow impeller is provided along the inner peripheral wall of the stirred tank and rotates around a vertical axis to form at least a flow directed toward a lower side in a stirring object existing in the stirred tank, and the shearing impeller imparts a shearing force to the stirring object by rotation, and is provided on a radially inward side of the flow impeller in the stirred tank and at a position contacting the flow of the stirring object formed by the flow impeller.

Further, the stirred tank can include a straight trunk part having a cylindrical shape, and a restricting part that is continued to a lower side of the straight trunk part and has an inner diameter decreasing toward the lower side, and the shearing impeller can be arranged with a distance of 10 to 30% in a ratio relative to an inner diameter of the straight trunk part from a bottom part of the stirred tank.

Further, ribbon blades can be used for the flow impeller and dispersion blades can be used for the shearing impeller.

Further, an inner impeller located on an inner side of the flow impeller in the stirred tank can be further provided, in which a rotational center of the inner impeller can be provided coaxially with rotational centers of the flow impeller and the shearing impeller.

Further, the flow impeller can include upper blades that are located on an upper side, and lower blades that are continued from the upper blades on a lower side of the upper blades.

Further, a heating and cooling part can be further provided, which is able to heat or cool the stirring object existing in the stirred tank through the inner peripheral wall of the stirred tank.

Further, a scraper can be further provided, which rotates along with the flow impeller, and rotates, while moving the stirring object located near the inner peripheral wall of the stirred tank.

DESCRIPTION OF EMBODIMENTS

Figure 1:
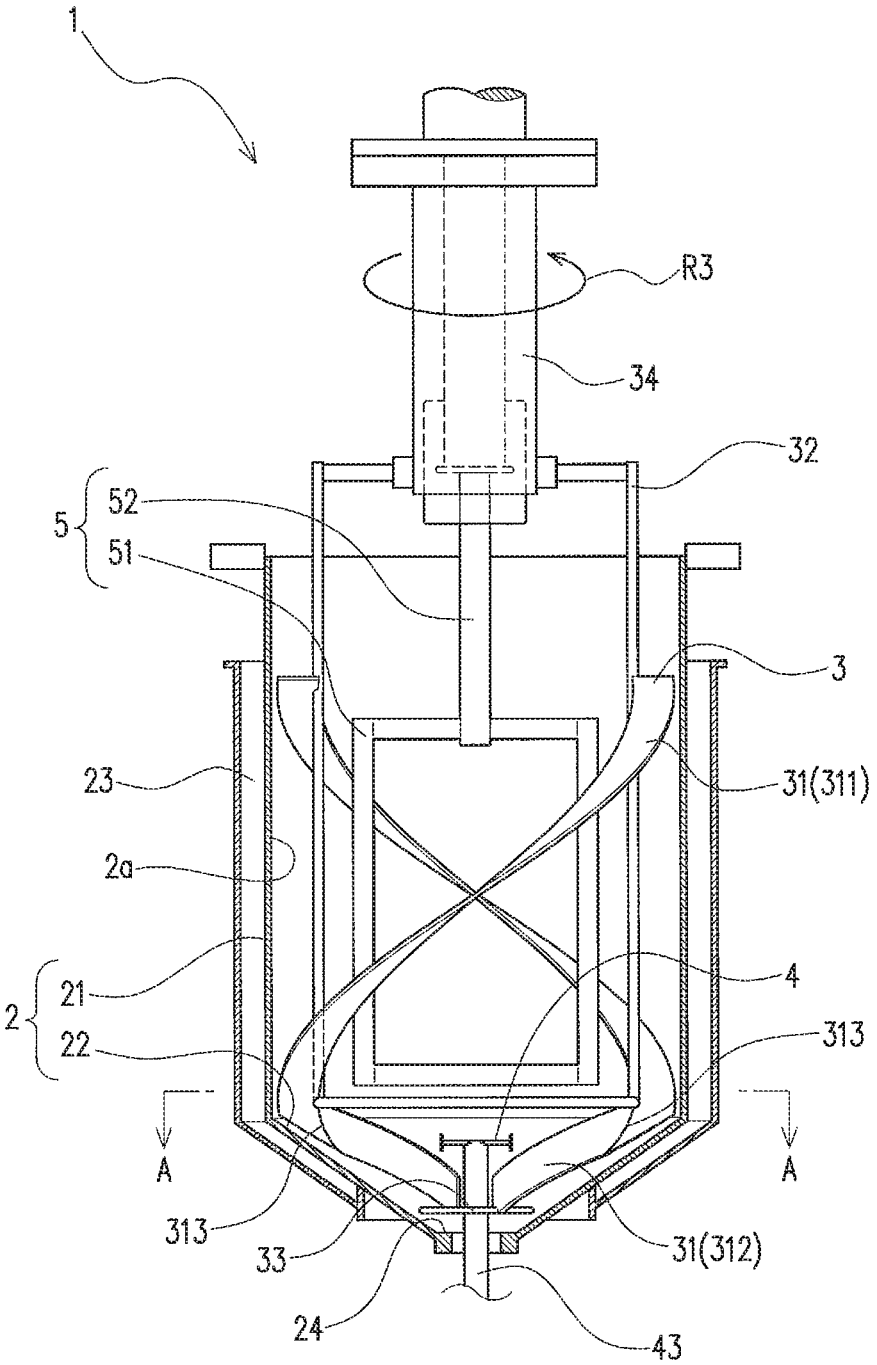
FIG. 1 is a vertical cross section showing a stirring device according to one embodiment of the present invention.

Hereinafter, a stirring device according to an embodiment of the present invention will be described. The stirring device 1 of this embodiment is used, for example, for emulsification. Various materials for, for example, cosmetics and food products can be used as a stirring object for emulsification but not be limited thereto. The stirring object has fluidity, examples of which include fluid (liquid, gas), particulate or powdered solid, and the combination thereof.

The stirring device 1 of this embodiment includes a flow impeller 3, a shearing impeller 4, and a gate impeller 5 in a stirred tank 2 that can store the stirring object. The respective impellers are configured to be rotatable independently of each other by being separately driven (monomotor driving) by a driving unit such as a motor provided outside the stirred tank 2. With this, it is possible to rotate these impellers at appropriate rotational speeds according to the characteristics of the stirring object. In the case where the stirring device 1 is used for emulsification, the flow impeller 3 mixes the stirring object for emulsification to form droplets. The shearing impeller 4 segments the droplets in an emulsified liquid to have smaller size. The gate impeller 5 as an inner impeller located inside of the flow impeller 3 in the stirred tank 2 suppresses the "co-rotation" of the stirring object due to the flow impeller 3. Thus, when emulsification is performed, even if a highly viscous liquid is used as the stirring object, it is possible to produce an effect to actively mix (knead) emulsifier or the like into the highly viscous liquid and therefore emulsification can be surely performed.

The stirred tank 2 is a container, of which an inner peripheral wall has a circular shape in cross section. An upper part of the stirred tank 2 is a straight trunk part 21 having a cylindrical shape and a lower part thereof is a restricting part 22 having a circular truncated cone shape. The straight trunk part 21 and the restricting part 22 are integrally formed. The inner diameter of the straight trunk part 21 is constant in a vertical direction. The restricting part 22 has an inner diameter decreasing toward the lower side. With the inner diameter of the stirred tank 2 configured in the manner mentioned above, it is possible to suppress the inner peripheral wall 2*a* of the stirred tank 2 from blocking an induced flow F (see FIG. 3) that is a flow directed toward the lower side of the stirring object generated by rotation of a flow impeller 3, which will be described below. The restricting part 22 may have a semicircular shape or a semielliptical shape in a vertical section. The upper end part of the stirred tank 2 shown in FIG. 1 is opened, while the upper end part may be closed. A jacket part 23 is formed outside the stirred tank 2 as a heating and cooling part, and a heating medium or a cooling medium is passed through the jacket part 23 so that the stirring object existing in the stirred tank 2 can be heated or have its heat removed (cooled).

In this embodiment, ribbon blades are used for the flow impeller 3. The flow impeller 3 is provided along the inner peripheral wall 2*a* of the stirred tank 2 and rotates around the vertical axis to form the induced flow F in the stirring object existing in the stirred tank 2. The induced flow F turns to be a part of a flow greatly flowing through the entire area inside the stirred tank 2. When the stirring device is used for emulsification, the stirring object is mixed and emulsified by the induced flow F, so that droplets are formed.

The flow impeller 3 of this embodiment is arranged along the inner peripheral wall 2*a* of the stirred tank 2, and includes a pair of flow impeller bodies 31 each having a certain width, a plurality of support rods 32 that support the flow impeller bodies 31 at radially inward positions, and a support ring 33 that couples to the flow impeller bodies 31 and supports them on the lower side. Each of the flow impeller bodies 31 has a curved band shape. The flow impeller body 31 includes an upper blade 311 and a lower blade 312. The upper blade 311 is disposed in the area extending within a range of 180 degrees in a plan view of the straight trunk part 21, and the lower blade 312 is disposed in the area extending within a range of substantially 90 degrees in a plan view of the restricting part 22. The two flow impeller bodies 31 are arranged in rotational symmetry at an interval of 180 degrees with the cross-section center of the stirred tank 2 therebetween.

Figure 2:
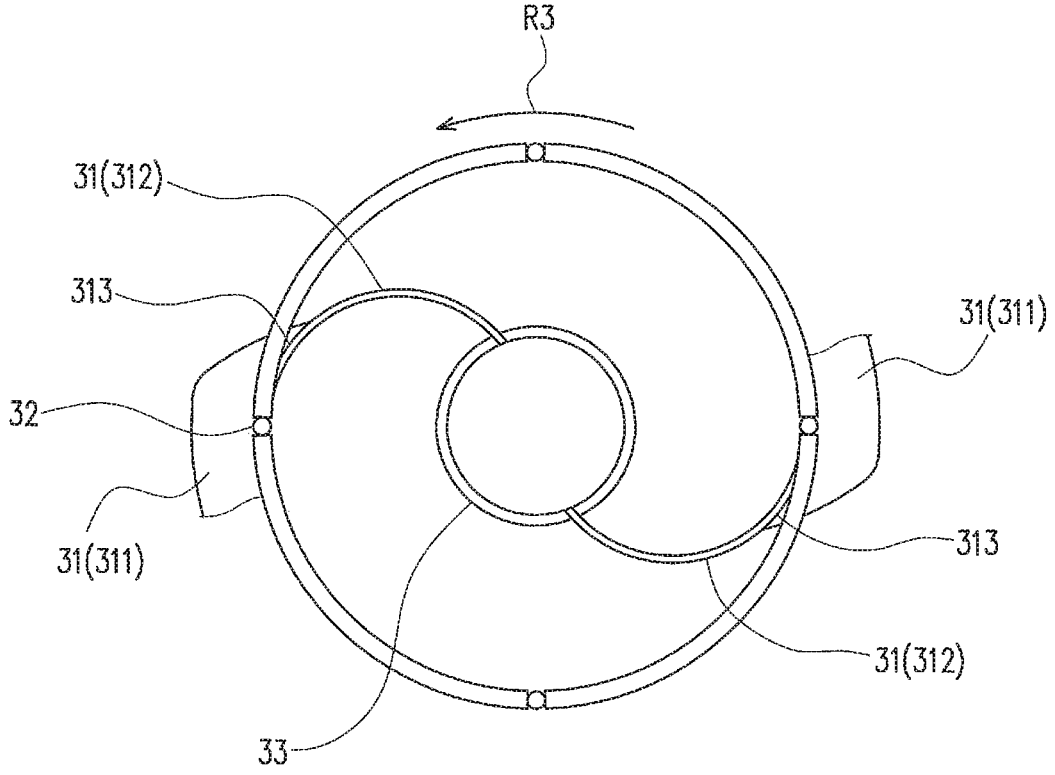
FIG. 2 is a view showing only flow impellers as viewed along the arrows A-A in FIG. 1.

The upper blade 311 is arranged at a certain distance from the inner peripheral wall of the straight trunk part 21 in the stirred tank 2, and extends from an upper side to a lower side, while being inclined at a certain angle in a circumferential direction. The upper blade 311 rotates in the straight trunk part 21 to thereby stir the stirring object and direct the same toward the lower side, thereby forming the induced flow F that is directed toward the lower side while circling. The lower blade 312 is located substantially along the surface shape of the inner peripheral wall of the restricting part 22 in the stirred tank 2. The lower blade 312 is formed to have a curved shape to bulge in a direction opposite to the rotational direction R3 in a plan view, as shown in FIG. 2.

The upper blade 311 and the lower blade 312 are connected to each other at joint portions 313 shown in FIG. 1 so that the surface directions of the respective blades are bent (or twisted). Specifically, as shown in FIG. 2, the upper blade 311 and the lower blade 312 are integrated by being connected to each other at the joint parts 313, for example, by welding, in a state where a surface of a band-shaped body constituting the lower blade 312 abuts a radially inward end edge of a band-shape body constituting the upper blade 311.

Figure 3:
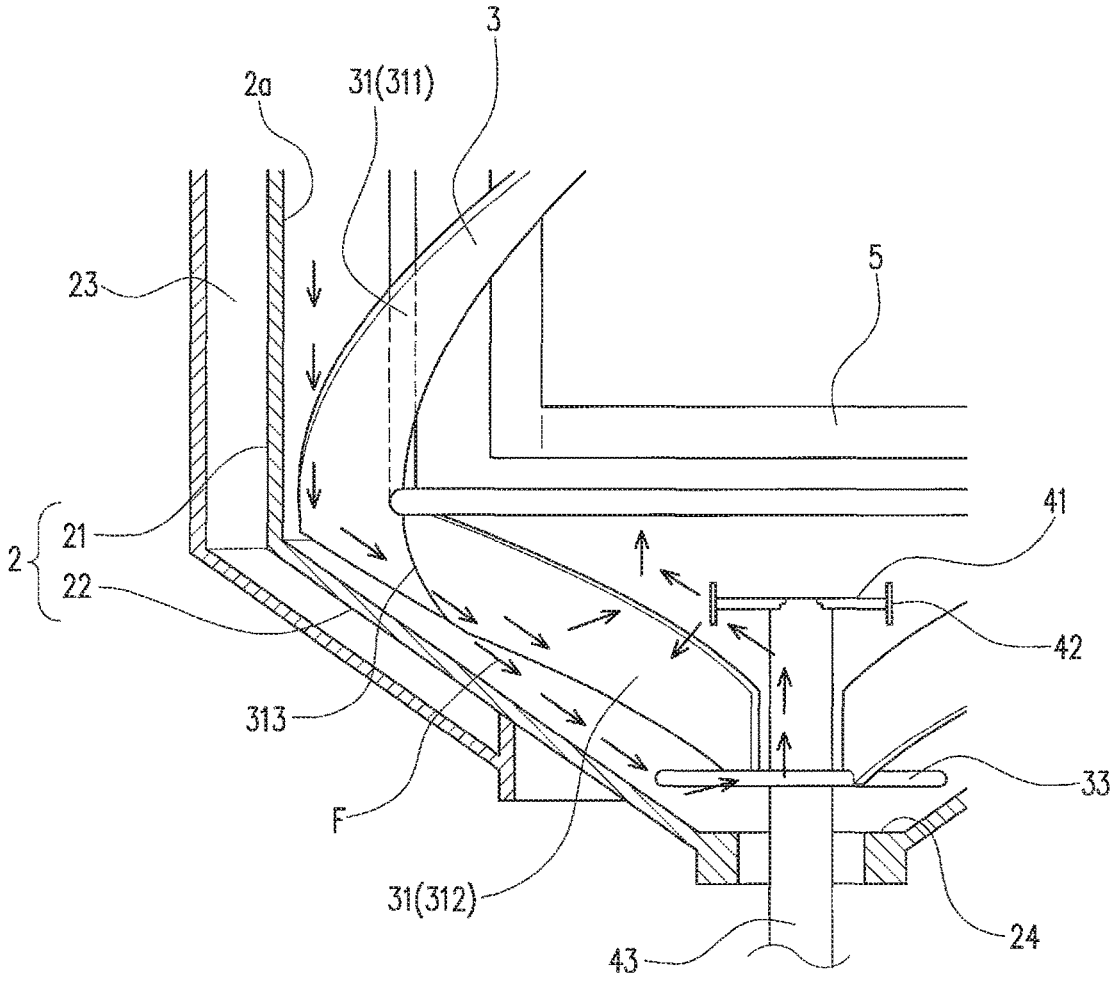
FIG. 3 is an enlarged view of a main part showing a flow of a stirring object in the stirring device.

The lower blade 312 rotates in the rotational direction R3 in the restricting part 22 so that the flowing direction of the induced flow F formed by the upper blade 311 directed toward the lower side while circling is converted to such a direction as to allow the induced flow F to be directed toward the lower side while being directed in a radially inward direction, as shown in FIG. 3. Therefore, the induced flow F can be directed to the shearing impeller 4.

Surfaces of the respective flow impellers 31 facing the lower side are portions producing an action of pushing the stirring object to the lower side. Thus, the surface of each of the respective flow impeller 31 facing the lower side has preferably a curved shape eliminating stepped portions as much as possible so as to allow the induced flow F to evenly flow. The certain distance mentioned above is determined in such a manner as that the inner peripheral wall 2*a* of the stirred tank 2 in this embodiment is located away from the outer peripheral edge of the respective flow impeller bodies 31 by a distance with a ratio of 1 to 3% relative to the inner diameter of the straight body part 21 in the stirred tank 2 in the horizontal direction; however, this distance can be appropriately set in accordance with the properties of the stirring object. The flow impeller bodies 31 are thus arranged in proximity to the inner peripheral wall 2*a* of the stirred tank 2 so that the flow impeller bodies 31 can surely form the induced flow F of the stirring object along the inner peripheral wall 2*a* of the stirred tank 2.

Further, the ratio of the width dimension of each of the flow impeller bodies 31 in the horizontal direction is 5 to 20% relative to the inner diameter of the straight body part 21 in the stirred tank. In this embodiment, it is set to be 10%. The width dimension thus set as above can secure a sufficient space on a radially inward side of the inner peripheral edges of the flow impeller bodies 31, and therefore a large flow of the stirring object circulating in the stirred tank 2 is not likely to be blocked. Therefore, heating and heat removing (cooling) performance is excellent, for example, in a case where a heating medium or a cooling medium is made to pass through the jacket part 23 to stir the stirring object while heating it or removing heat therefrom (cooling it). Therefore, it is possible to provide the stirring device 1 of a large size. Further, with the configuration where a center shaft or a center impeller, to which the stirring object may adhere, is not present at the center of the stirred tank 1, and therefore adhesion of the stirring object (such as a highly viscous liquid) to the shaft or the like and stagnation thereof in the stirred tank 2 can be prevented. The width dimension of the flow impeller bodies 31 is not limited to the above ratio and can be appropriately set in accordance with the properties of the stirring object.

The flow impeller bodies 31 and the support rods 32, and the flow impeller bodies 31 and the support ring 33, in the flow impeller 3 are respectively integrated, for example, by welding. The support rods 32 are a straight rod body extending in a vertical direction and fix the flow impeller bodies 31 on the upper side and the lower side. The support rods 32 are connected, through a driving shaft 34 for flow impeller, to a driving part for flow impeller (not shown) provided above the stirred tank 2. With this, the flow impeller bodies 31 can be rotated through the support rods 32 around the vertical axis extending in the vertical direction. On the other hand, the support ring 33 fixes lower ends of the flow impeller bodies 31. A driving shaft 43 for shearing impeller extending in the vertical direction passes through the inside of the support ring 33. As shown in FIG. 3, the induced flow F of the stirring object moves upward from a bottom portion of the restricting part 22 along the outer periphery of the driving shaft 43 for shearing impeller, passes through a gap between the driving shaft 43 for shearing impeller and the support ring 33, and hence is induced to a circular disk part 41.

The flow impeller 3 rotates in the rotational direction R3 that is a counterclockwise direction in a plan view. The rotational number of the flow impeller 3 is lower than the rotational number of the shearing impeller 4. By this rotation, the flow impeller bodies 31 press the stirring object downward. Thus, as shown in FIG. 3, the induced flow F directed toward the lower side along the inner peripheral wall 2*a* of the stirred tank 2 is generated. The induced flow F directed toward the lower side is, as described below, a flow that continuously supplies the stirring object to the shearing impeller 4. Further, the induced flow F directed toward the lower side constantly exists in the proximity to the inner peripheral wall 2*a* of the stirred tank 2 and thereby the stirring object is not likely to stagnate in the stirred tank 2 so that the adhesion of the stirring object to the inner peripheral wall 2*a* of the stirred tank 2 can be suppressed. Even when the stirring object adheres to the inner peripheral wall 2*a* of the stirred tank 2, the stirring object can be removed from the inner peripheral wall 2*a* by providing a scraper 6 as described below.

The shearing impeller 4 imparts a shearing force to the stirring object by rotation. When the stirring device 1 is used for emulsification, droplets formed by the flow impeller 3 are broken by this shearing force and segmentalized.

As this shearing impeller 4, a dispersion impeller is used in this embodiment. The dispersion impeller of this embodiment is, as shown in FIG. 3, an impeller having a plurality of shearing teeth 42 that extend in a direction intersecting with a plane direction of the circular disk part 41 are provided along an outer peripheral edge of the rotatable circular disk part 41 at intervals in a circumferential direction (in FIG. 3, only the shearing teeth 42 existing at the right and left ends are shown in a schematic manner). The shearing teeth 42 are provided along the outer peripheral edge of the circular disk part 41. The shearing teeth 42 can be provided to be inclined relative to a tangential direction of the outer peripheral edge of the circular disk part 41 to form a discharge flow of the stirring object in a radially outward direction. The shearing teeth 42 of this embodiment project equally in a front and rear direction (vertical direction) to have the circular disk part 41 as a reference; however, they are required to project at least to a lower side, and it may be configured so that the shearing teeth 42 projecting in the front direction and the shearing teeth 42 projecting in the rear direction may be disposed alternately each other. Or, the shearing teeth 42 can be provided anywhere other than the outer peripheral edge of the circular disk part 41.

The ratio of the diameter of the shearing impeller 4 is from 10 to 30% relative to the inner diameter of the straight trunk part 21 in the stirred tank 2. With this, the stirring object can be induced to the shearing impeller 4 under the conditions with a strong upward force of the induced flow F (the conditions with a non-depressed upward force).

With rotation of this shearing impeller 4, the shearing teeth 42 collide with the stirring object. At the moment, the front edge portions in the rotational direction of the shearing teeth 42 can cause a shearing force to the stirring object. That is, a periphery of the rotational trajectory of the shearing teeth 42 becomes a high-shear field.

The driving shaft 43 for shearing impeller extending to the lower side is connected to the shearing impeller 4. Although no illustration is provided, a seal is provided between the stirred tank 2 and the driving shaft 43 for shearing impeller so as to prevent leakage of the stirring object. The driving shaft 43 for shearing impeller is connected to a driving part for shearing impeller (not shown) provided below the stirred tank 2. With this, the shearing impeller 4 can be rotated around the vertical axis extending in the vertical direction.

As described above, the driving part for flow impeller (not shown) to rotate the flow impeller 3 is located above the stirred tank 2. The driving part for shearing impeller to rotate the shearing impeller 4 is located below the stirred tank 2. This configuration can shorten the shaft lengths 34, 43 connecting to the driving parts with the corresponding impellers and can suppress occurrence of shaft deflection or shaft displacement and hence can suppress the vibration (resonance) at the time of driving. Specifically, for the shearing impeller 4, the shaft length of the driving shaft 43 for shearing impeller can be shortened, and hence high-speed rotation becomes possible. It is also possible to suppress occurrence of fatigue failure of the driving shaft 43 for shearing impeller or the like due to the vibration.

The shearing impeller 4 is provided to have a dimension from the bottom part of the stirred tank 2 to the mounting portion being smaller than the dimension of the inner diameter of the straight trunk part 21 in the stirred tank 2. Further, the shearing impeller 4 is provided at a position radially inward of the flow impeller 3 in the stirred tank 2, and, as shown in FIG. 3, the shearing impeller is provided at a position contacting the induced flow F formed by the flow impeller 3, and more specifically, at a position where the induced flow F is strong. Therefore, the stirring object surely reaches the shearing impeller 4 at the position where the induced flow F of the stirring object formed by the flow impeller 3 is strong. Therefore, the stirring object is continuously supplied to the shearing impeller 4 by the flow impeller 3. Specifically, as shown in FIG. 3, the induced flow F reaches from the inner side of the shearing impeller 4 to the shearing teeth 42 located at the impeller tip of the shearing impeller 4, and therefore the stirring object is surely supplied from the flow impeller 3 to the high-shear field. As a result, even if the shearing impeller 4 rotates, a void is unlikely to be generated around the shearing impeller 4 unlike the conventional configuration so that idle rotation of the shearing impeller 4 in the high-shear field can be prevented. Thus, shearing of the stirring object by the shearing impeller 4 is surely carried out.

As described above, rotation of the flow impeller 3 first generates the induced flow F in the stirring object in the straight trunk part 21, which is directed toward the lower side along the inner peripheral wall 2*a* of the stirred tank 2. The restricting part 22 is formed at the lower part of the stirred tank 2, and the lower blade 312 of the flow impeller 3 rotates at the restricting part 22 so that the induced flow F in the restricting part 22 changes its flow direction, as shown in the FIG. 3, to a direction, in which the induced flow F is directed toward the radially inward side of the stirred tank 2, while being directed toward the lower side. Consequently, the induced flow F concentrates at a center of the lower end of the restricting part 22 so that the flow direction at the center of the lower end of the restricting part 22 is reversed, causing the induced flow F to flow upward. The induced flow F, the flow direction of which has been reversed to the upward flow direction, comes in contact with the shearing impeller 4 (in particular, the circular disk part 41 of the dispersion impellers).

The direction of the induced flow F is thus reversed by the flow impeller 3 and the inner peripheral wall 2*a* of the stirred tank 2 to circulate the stirring object within the stirred tank 2 so that the stirring object is actively supplied to the shearing impeller 4. In the case of emulsification, oil droplets or water droplets can be surely segmentalized by shearing of the shearing impeller 4.

Thus, it is preferable that the stirring object be supplied to a position close to the rotational center (vertical axis) of the shearing impeller 4 by the flow impeller 3. This is because the stirring object can be supplied to a position away from the shearing teeth 42 so as not to be bounce back before the shearing object supplied by the flow impeller 3 reaches the shearing impeller 4 due to pumping-out of the stirring object by the shearing teeth 42. This is effective especially for the case where the stirring object is a fluid of high thixotropy.

The shearing impeller 4 is arranged at a distance of 10 to 30% from the bottom part of the stirred tank 2 (bottom surface 24 in this embodiment), preferably at a distance of 15 to 25% as a proportion relative to the inner diameter of the straight trunk part 21.

Here, the high-speed rotation stirring impeller described in Japanese UM Application Laid-open No. H5-85433 is, as shown in the Official Gazette, provided at a high position (substantially the same dimension as the inner diameter of the stirred tank) away from the bottom part of the stirred tank. In the stirring device described in the Official Gazette, even though the stirring object is induced by the ribbon-shaped stirring impeller to the lower part of the stirred tank and then the stirring object is raised, the stirring object comes in contact with the high-speed rotation stirring impeller in a state where an upward force of the stirring object is weak (a state where an upward force has been reduced) due to provision of the high-speed rotation stirring impeller at the high position away from the bottom part of the stirred tank. Therefore, at the time of shearing the stirring object using the high-speed rotation stirring impeller, a sufficient amount of the stirring object that can compensate the stirring object pumped out by the shearing teeth is not supplied, so that the stirring object may not easily flow into an area, from which the stirring object has been pushed out, from the surrounding area in some cases. In such a case, a void (hollow space) with no stirring object is generated around the shearing blade (or around the high-speed rotation stirring impeller itself). Accordingly, the shearing teeth cannot catch the stirring object and thereby the high-speed rotation stirring impeller runs idle, which may cause a phenomenon of making it hard for the stirring object to be stirred.

Contrary to this, in this embodiment, the shearing impeller 4 is arranged at the above-mentioned distance away from the bottom part 24 of the stirred tank 2 so that the flow of the stirring object resulting from the rotation of the flow impeller 3, specifically, the induced flow F changed its flow direction to upward at the center of the bottom end of the restricting part 22 can surely contact the shearing impeller 4 while the upward force of the induced flow F is kept strong. Therefore, the shearing of the stirring object by the shearing impeller 4 is surely carried out.

Here, in this embodiment, the flow impeller 3 is composed of the ribbon blades and the shearing impeller 4 is composed of the dispersion blades. Accordingly, it is possible to provide a combination of the flow impeller 3 and the shearing impeller 4 composed of blades having shapes most appropriate to the purpose for, for example, performing segmentation of droplets in an emulsified liquid.

Both of the rotational center of the flow impeller 3 and the rotational center of the shearing impeller 4 pass through the center in the cross-section of the stirred tank 2. In comparison with the configuration, in which the rotational centers of the respective impellers are displaced from each other, the distances between the impellers 3, 4 and the inner peripheral wall 2*a* of the stirred tank 2 can be made constant by the configuration, in which the rotational centers are coaxially provided as in this embodiment. Because of this configuration of the stirred tank 2, the induced flow F of the stirring object directed from the flow impeller 3 to the shearing impeller 4 becomes constant in the circumferential direction. Accordingly, a horizontal load applied to the shearing impeller 4 can be reduced, and thereby enabling suppression of breakage of, for example, the driving shaft 43 for shearing impeller.

The gate impeller 5 includes a gate impeller body 51 that is formed in a frame shape, specifically, in a rectangular frame shape that is a symmetrical shape relative to the rotational center (vertical axis) as shown in Figures. The gate impeller 5 is configured to rotate in a direction opposite to the flow impeller 3, or when it rotates in the same direction, it is configured to rotate at a different rotational speed. A driving part (not shown) for the gate impeller to rotate the gate impeller is located above the stirred tank 2. In this embodiment, a driving shaft 52 for gate impeller that is located above the gate impeller body 51 and is to be connected to the driving part for the gate impeller is coaxially arranged with the driving shaft 34 for the flow impeller. The driving part for the gate impeller can be concurrently the driving part for the flow impeller. In such a case, it is configured to supply driving forces to the flow impeller 3 and the gate impeller respectively at different rotational speeds (or in different rotational directions) through a reduction gear or the like.

The combination of the flow impeller 3 and the gate impeller 5 cause a difference between the movement of the stirring object caused by the rotation of the gate impeller 5 and the movement of the stirring object caused by the rotation of the flow impeller 3 in the stirred tank 2. This can suppress "co-rotation" such that the stirring object moves jointly with the flow impeller 3 in the stirred tank 2, and smoothly flow the stirring object across the inside of the stirred tank 2.

The gate impeller 5 is not essential in the present invention and a configuration without the gate impeller 5 may be employed. However, it is preferable to provide the gate impeller 5 because the gate impeller 5 has a merit to suppress the "co-rotation".

By the stirring device 1 of this embodiment as configured above, the induced flow F of the stirring object formed by the flow impeller 3 can reach the shearing impeller 4 so that the stirring object is constantly supplied from the flow impeller 3 to the shearing impeller 4. Therefore, a void is unlikely to be caused around the shearing impeller 4 during its rotation, and the shearing of the stirring object by the shearing impeller 4 is surely carried out. Accordingly, the stirring device 1 of this embodiment is suitable to the case where the rotational speed of the shearing impeller 4 is largely set. Further, regardless of the rotational number (or the rotational speed) of the shearing impeller 4, the stirring device 1 is suitable when the stirring object is a fluid having a high viscosity of 1000 cP (1 Pa·s) or more, and when the stirring object is a highly thixotropic fluid. Regarding the viscosity, the stirring device 1 is suitable when the stirring object is an ultra-high viscosity fluid having a viscosity of 100,000 cP (100 Pa·s) or more.

Further, when the stirring device 1 of this embodiment is used for emulsification, even though the stirring (emulsifying) object is a high viscosity fluid, droplets in submicron class (less than 1 μm in diameter) can be dispersed. The stirring device 1 of this embodiment thus can exhibit an ability of high shearing performance, and is very excellent compared with the conventional stirring device.

Figure 4:
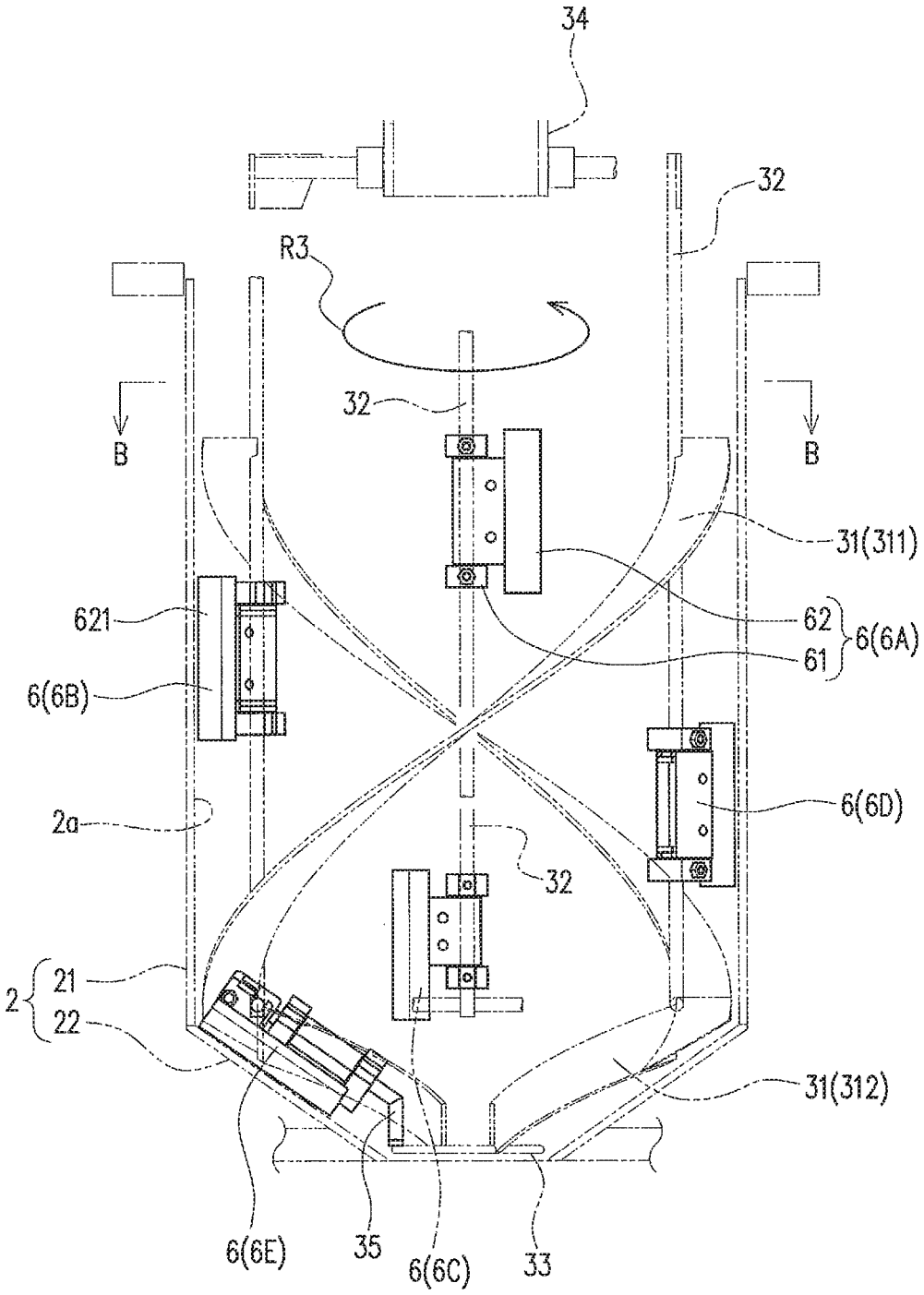
FIG. 4 is a vertical cross section showing a main part of the stirring device according to another embodiment of the present invention.
Figure 5:
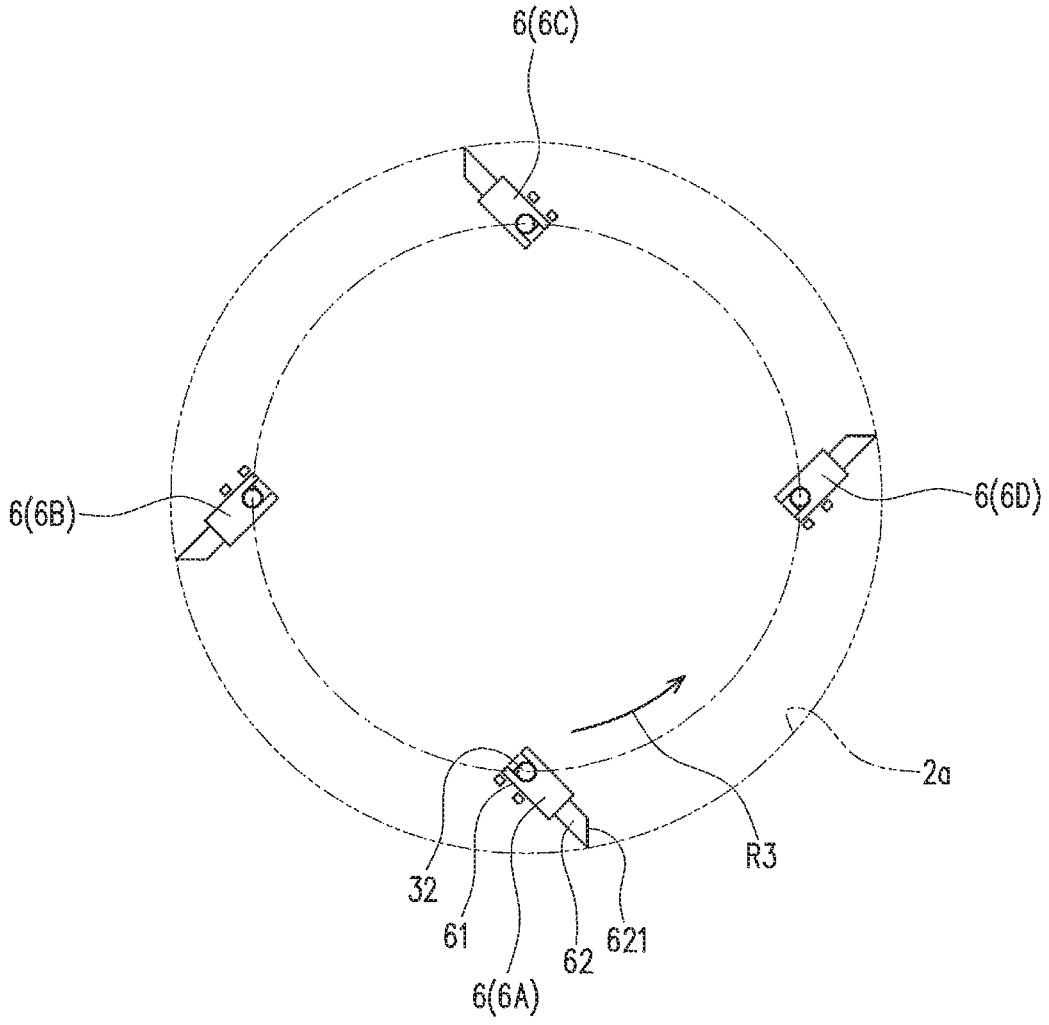
FIG. 5 is a schematic view showing an arrangement of a scraper in cross section taken along the arrows B-B in FIG. 4.

The stirring device 1 can be provided with a plurality of scrapers 6, as shown in FIG. 4 and FIG. 5. The respective scrapers 6 are configured to rotate along with the flow impeller 3, and thereby to be able to move the stirring object located near the inner peripheral wall 2*a* of the stirred tank 2. In this embodiment, four scrapers 6A to 6D are provided corresponding to the inner peripheral wall of the straight trunk part 21 on the upper part of the tank, and one scraper 6E is provided corresponding to the inner peripheral wall of the restricting part 22 on the lower part of the tank.

Each of the scrapers 6 includes an attaching part 61 and a scraping part 62. The attaching part 61 is attached to a portion other than the flow impeller body 31 of the flow impeller 3. In this embodiment, the scrapers 6A to 6D corresponding to the inner peripheral wall of the straight trunk part 21 are attached to the support rods 32, and the scraper 6E corresponding to the inner peripheral wall of the restricting part 22 is attached to a bracket 35 fixed to the support ring 33. In this embodiment, the scraper 6E is attached by a bolt. However, it is possible to fix the attaching part 61 to the flow impeller 3 to be integrated with the same by welding or the like. The attaching part 61 can be thus attached to any portion other than the flow impeller bodies 31. As shown in FIG. 4, the attaching parts 61 of the scrapers 6A, 6B, and 6D, the attaching part 61 of the scraper 6C, the attaching part 61 of the scraper 6C, and the attaching part 61 of the scraper 6E are respectively different in shape from each other. The attaching parts 61 are thus formed with an appropriate shape according to the positions at which they are attached to the flow impeller 3.

Further, the attaching parts 61 of the plurality of scrapers 6 are provided at positions such where the movement trajectories of the scraping parts 62 mounted to the attaching parts 61 of the scrapers 6 do not overlap each other. This enables the stirring object, which is located near the inner peripheral wall 2*a*, to be moved across a wide area of the inner peripheral wall 2*a* of the stirred tank 2.

The scraping part 62 is mounted to the attaching part 61. The scraping part 62 is a movable part mounted with an allowance to the attaching part 61 that is a fixing part. Specifically, regarding the scrapers 6A to 6D corresponding to the inner peripheral wall of the straight trunk part 21, the scraping parts 62 are rotatable within a certain range relative to the support rods 32. Regarding the scraper 6E corresponding to the inner peripheral wall of the restricting part 22, the scraping part 62 is rotatable within a certain range relative to the bracket 35. The scraping parts 62 are (rotatably) mounted with an allowance to the attaching parts 61, thereby enabling the scraping part 62 to surely move in conformity with the inner peripheral wall 2*a* even if the inner peripheral wall 2*a* is not a true circle in cross section. Although a hard material can be used for the scraping part 62, it is preferable to use a flexible material so as to surely scrape off the stirring object adhered to the inner peripheral wall 2*a*, while avoiding damage of the inner peripheral wall 2*a* of the stirred tank 2. The scraping part 62 of this embodiment is formed by a synthetic resin. The composition of the synthetic resin can be selected from various compositions in accordance with the physical properties of the stirring object and the temperature during stirring.

As shown in FIG. 5, the scraping part 62 is in the form of a plate, and a distal end 621 facing the inner peripheral wall 2*a* of the stirred tank 2 has a tapered shape. The scraping part 62 is inclined toward the rotational direction R3 of the flow impeller 3 as shown in Figures and provided to have the distal end directed toward the downstream side in the rotational direction. An angle of the scraping part 62 relative to the rotational direction R3 (specifically, an angle within a certain range, in which the scraping part 62 is rotatable relative to the support rod 32 or the bracket 35) can be adjusted according to the mounting angle of the attaching part 61 to the flow impeller 3 (the support rod 32 or the bracket 35 in this embodiment). The distal end 621 of the scraping part 62 is, as shown in FIG. 4, located slightly away from the inner peripheral wall 2*a* of the stirred tank 2 when the flow impeller 3 does not rotate. The scraping part 62 pushes the stirring object by the rotation of the flow impeller 3 so that the scraping part 62 is subjected to a resistance force from the stirring object and thereby rotates relative to the mounting portion (the support rod 32 or the bracket 35 in this embodiment) of the flow impeller 3. With this rotation, the scraping part 62 comes close to the inner peripheral wall 2*a* of the stirred tank 2, and thus, the distal end 621 abuts the inner peripheral wall 2*a* of the stirred tank 2 or comes close thereto with a slight gap. In this state, the scraping part 62 moves the stirring object located near the inner peripheral wall 2*a* of the stirred tank 2, while the scraping part 62 rotates along with the flow impeller 3 so that the amount of the stirring object located near the inner peripheral wall 2*a* can be reduced. In particular, when in the abutting state, the scraping part 62 rotates along with the flow impeller 3, while scrubbing the inner peripheral wall 2*a* of the stirred tank 2, so that the stirring object adhered to the inner peripheral wall 2*a* of the stirred tank 2 is surely scraped off.

Providing the scraper 6 thus configured enables to reduce the amount of the stirring object adhered to (or remains on)

the inner peripheral wall 2*a* of the stirred tank 2 so as to have the inner peripheral wall 2*a* exposed, or the inner peripheral wall 2*a* slightly covered with the stirring object. Therefore, it can suppress the heat transfer to the inside of the stirred tank 2 by the jacket part 23 from being blocked due to thickened accumulation of the stirring object on the inner peripheral wall 2*a* of the stirred tank 2, which was easily caused especially when the stirring object is a high viscosity fluid. Accordingly, the stirring object located inside of the stirred tank 2 can be effectively heated or have its heat removed (cooled). Further, because the stirring object is unlikely to stagnate in an area near the inner peripheral wall 2*a* in the stirred tank 2 by the scraper 6, the stirring efficiency of the stirred tank 2 can be improved. Further, the stirring object, which has been scraped off, is moved to the inside of the stirred tank 2 and induced to the flow impeller 3. Therefore, the amount of the stirring object directed from the flow impeller 3 toward the shearing impeller 4 can be increased.

The stirring device according to the present invention is not limited to the aforementioned embodiment, and can be subjected to various modifications within the gist of the present invention.

For example, the flow impeller 3 is composed of the ribbon blades in the aforementioned embodiment, but there is no limitation to this. The flow impeller 3 may be configured so that at least one inclined flow impeller body 31 is arranged within the stirred tank 2 and push the stirring object downward along with movement (rotation in the aforementioned embodiment) of the flow impeller bodies 31 in the stirred tank 2. Thus, it can be embodied with various configurations. The flow impeller bodies 31 each may have a curved plate (band) shape as in the aforementioned embodiment or a flat plate shape.

Further, when the ribbon blades are used as the flow impeller 3, it is not limited to the configuration as aforementioned embodiments, in which the two flow impeller bodies 31 are used, one being arranged within a range of 180 degrees relative to the upper blade 311 and another being arranged within a range of substantially 90 degrees relative to the lower blade 312. It is possible to set the arrangement range of the flow impeller body flow impeller bodies 31 to be an arbitrary angle from 90 degrees to 360 degrees, and set the number of the flow impeller bodies 31 to an arbitrary number of at least one or three or more.

Further, the shearing impeller 4 is not limited to the dispersion blades of the aforementioned embodiment, and it may be a blade having a different shape. For example, it may be of a disk turbine blade or a paddle blade.

Further, plural shearing impellers 4 may be provided in multiple stages in the vertical direction. In this case, the shearing impellers 4 of the plural stages may have different shapes. It is also possible to provide plural flow impellers 3.

Further, the gate impeller 5 of the aforementioned embodiment includes the gate impeller body 51 formed in a rectangular frame shape that is a symmetrical shape relative to the rotational center (vertical axis); however, the shape of the gate impeller body 51 is not limited to a specific shape. The gate impeller body 51 can be formed in various shapes as long as it surrounds at least a part of a space located on the extended line of the rotational center (vertical axis) of the flow impeller 3 and the shearing impeller 4 within the stirred tank 2. Accordingly, the gate impeller body 51 can be formed, for example, in such a shape formed by cutting the gate impeller body 51 into half along the rotational center (vertical axis), or in a polygonal frame shape or an elliptical frame shape.

Further, a baffle can be provided within the stirred tank 2. This baffle is formed of, for example, a rod shaped body and a plate shaped body, and immovably located within the stirred tank, and imparts a shearing force to the stirring object flowing within the stirred tank by abutment therewith.

Further, the stirring device 1 of this embodiment performs a batch process; however, there is no limitation to this, and the stirring device 1 may be configured to carry out continuous processing by successively supplying the stirring object into the stirred tank.

Lastly, the aforementioned embodiment is summarized. This embodiment is a stirring device 1 for stirring a stirring object having fluidity that includes a stirred tank 2, of which an inner peripheral wall 2*a* has a circular shape in cross section, and at least one flow impeller 3 and at least one shearing impeller 4 that are located inside the stirred tank 2 and are configured to be rotatable independently of each other, in which rotational centers of the flow impeller 3 and the shearing impeller 4 are coaxially provided, the flow impeller 3 is provided along the inner peripheral wall 2*a* of the stirred tank 2 and rotates around a vertical axis to form at least a flow directed toward the lower side in a stirring object existing in the stirred tank, and the shearing impeller 4 imparts a shearing force to the stirring object by rotation and is provided on a radially inward side of the flow impeller 3 in the stirred tank 2 and at a position contacting the flow of the stirring object formed by the flow impeller 3.

According to this configuration, the flow of the stirring object formed by the flow impeller 3 reaches the shearing impeller 4, so that the stirring object is surely supplied from the flow impeller 3 to the shearing impeller 4. Therefore, even when a high rotational speed is set to the shearing impeller 4, or even if the stirring object is a high viscosity fluid or a highly thixotropic fluid, a void is unlikely to be caused around the shearing impeller 4 during its rotation, thereby enabling suppression of idle rotation of the shearing impeller 4, so that the shearing of the stirring object by the shearing impeller 4 is surely carried out.

Further, the stirred tank 2 includes a straight trunk part 21 having a cylindrical shape and a restricting part 22 that is continued to a lower side of the straight trunk part 21 and has an inner diameter decreasing toward the lower side, and the shearing impeller 4 can be arranged with a distance of 10 to 30% in a ratio relative to an inner diameter of the straight trunk part 21 from a bottom part of the stirred tank 2.

According to this configuration, the flow of the stirring object along with the rotation of the flow impeller 3 can be surely brought into contact with the shearing impeller 4.

Further, ribbon blades can be used for the flow impeller 3, and dispersion blades can be used for the shearing impeller 4.

According to this configuration, it is possible to provide a combination of the flow impeller 3 and the shearing impeller 4 that are composed of blades having optimal shapes for processing the stirring object.

Further, the stirring device 1 can further include a gate impeller 5 located inward of the flow impeller 3 in the stirred tank 2 and the gate impeller 5 has a rotational center coaxial with the rotational center of the flow impeller 3 and the shearing impeller 4.

According to this configuration, the flow impeller 3 and the gate impeller 5 are combined so that it is possible to cause a difference between the movement of the stirring object caused by the rotation of the gate impeller 5 and the movement of the stirring object caused by the rotation of the flow impeller 3. This can suppress "co-rotation" such that the stirring object moves jointly with the flow impeller 3 in the stirred tank 2. Thus, the stirring object can be made to flow smoothly across the inside of the stirred tank 2.

Further, the flow impeller 3 can include upper blades 311 that are located on an upper side, and lower blades 312 that are continued from the upper blades 311 on a lower side of the upper blades 311.

According to this configuration, the lower blades 312 rotate so that the flowing direction of the stirring object formed by the upper blades 311 directed toward the lower side while circling is converted to such a direction as to allow the flow to be directed toward the lower side while flowing in a radially inward direction of the stirred tank 2. Therefore, the flow of the stirring object can be surely induced to the shearing impeller 4.

Further, the stirring device 1 can further include a jacket part 23 that is able to heat or cool the stirring object existing in the stirred tank 2 through the inner peripheral wall 2*a* of the stirred tank 2.

According to this configuration, the stirring object existing within the stirred tank 2 can be heated or have its heat removed (cooled) by passing a heating medium or a cooling medium through the jacket part 23.

Further, the stirring device 1 can further include a scraper 6 that rotates along with the flow impeller 3, and rotates, while moving the stirring object located near the inner peripheral wall 2*a* of the stirred tank 2.

According to this configuration, the stirring object located near the inner peripheral wall 2*a* of the stirred tank 2 is moved so that the amount of the stirring object located near the inner peripheral wall 2*a* can be reduced, and thereby it is possible to suppress the stirring object from blocking the heat transfer to the inside of the stirred tank 2 by the jacket part 23. Accordingly, it is possible to effectively perform the heating and cooling of the stirring object located inside the stirred tank 2.

As described above, according to this embodiment, shearing of the stirring object by the shearing impeller 4 can be surely carried out. Therefore, it is possible to suppress the shearing impeller 4 from running idle, and suppress occurrence of a phenomenon of making it hard to shear the stirring object.

REFERENCE SIGNS LIST

1 Stirring device
2 Stirred tank
2*a* Inner peripheral wall of stirred tank
21 Straight trunk part
22 Restricting part
23 Heating and cooling part, jacket part
24 Bottom part, bottom surface
3 Flow impeller, ribbon blade
311 Upper blade
312 Lower blade
4 Shearing impeller, dispersion blade
5 Inner impeller, gate impeller
6 Scraper
F Flow of stirring object, induced flow

The invention claimed is:

1. A stirring device configured to stir a material having fluidity to obtain a stirred object material, comprising:

a stirred tank, of which an inner peripheral wall has a circular shape in cross section, and at least one flow impeller and at least one shearing impeller that are located inside the stirred tank and configured to be rotatable independently of each other, wherein rotational centers of the flow impeller and the shearing impeller are coaxially provided, the flow impeller is provided along the inner peripheral wall of the stirred tank and comprises a flow impeller body having a band shape configured to rotate around a vertical axis to form at least a flow directed toward a lower side in the material existing in the stirred tank, the shearing impeller comprises a rotatable circular disk part and a plurality of shearing teeth provided at intervals in a circumferential direction of the circular disk part, each of the plurality of shearing teeth is configured to collide with the material by rotation of the shearing impeller to impart a shearing force to the material, the shearing force breaks droplets of the material for segmentalization when the stirring device is used for emulsification, and the shearing impeller is provided in one stage or a plurality of shearing impellers are provided in multiple stages in a vertical direction of the stirred tank at a lower part of the stirred tank, and the shearing impeller or the plurality of shearing impellers are provided on a radially inward side of the flow impeller in the stirred tank and on a position contacting the flow formed by the flow impeller.

2. The stirring device according to claim 1, wherein the stirred tank comprises a straight trunk part having a cylindrical shape, and a restricting part that is continued to a lower side of the straight trunk part and has an inner diameter decreasing toward the lower side, and the shearing impeller is arranged with a distance of 10 to 30% in a ratio relative to an inner diameter of the straight trunk part from a bottom part of the stirred tank.

3. The stirring device according to claim 1, wherein ribbon blades are used for the flow impeller and dispersion blades are used for the shearing impeller.

4. The stirring device according to claim 1, further comprising an inner impeller located on an inner side of the flow impeller in the stirred tank, wherein a rotational center of the inner impeller is provided coaxially with rotational centers of the flow impeller and the shearing impeller.

5. The stirring device according to claim 1, wherein the flow impeller comprises upper blades that are located on an upper side, and lower blades that are continued from the upper blades on a lower side of the upper blades.

6. The stirring device according to claim 1, further comprising a heating and cooling part that is able to heat or cool the material existing in the stirred tank through the inner peripheral wall of the stirred tank.

7. The stirring device according to claim 6, further comprising a scraper that rotates along with the flow impeller, and rotates, while moving the material located near the inner peripheral wall of the stirred tank.

* * * * *